US009315766B2

(12) United States Patent
He et al.

(10) Patent No.: US 9,315,766 B2
(45) Date of Patent: Apr. 19, 2016

(54) SOLID PARTICLE FOR WASHING AND WASHING METHOD USING THE SAME

(75) Inventors: Zhengbao He, Laoshan (CN); Chunfeng Lao, Qingdao (CN)

(73) Assignees: HAIER GROUP CORPORATION, Qingdao, Shandong (CN); HAIER GROUP TECHNIQUE R&D CENTER, Qingdao, Shandong (CN)

( * ) Notice: Subject to any disclaimer, the term of this patent is extended or adjusted under 35 U.S.C. 154(b) by 0 days.

(21) Appl. No.: 14/124,281

(22) PCT Filed: Nov. 11, 2011

(86) PCT No.: PCT/CN2011/082078

§ 371 (c)(1), (2), (4) Date: Dec. 6, 2013

(87) PCT Pub. No.: WO2012/167545

PCT Pub. Date: Dec. 13, 2012

(65) Prior Publication Data

US 2014/0096328 A1 Apr. 10, 2014

(30) Foreign Application Priority Data

Jun. 9, 2011 (CN) ..... 2011 1 0153607
Sep. 7, 2011 (CN) ..... 2011 1 0264195

(51) Int. Cl.

| | |
|---|---|
| ***C11D 3/37*** | (2006.01) |
| ***C11D 3/02*** | (2006.01) |
| ***C11D 3/12*** | (2006.01) |
| ***C11D 17/00*** | (2006.01) |
| ***C11D 17/06*** | (2006.01) |
| ***D06F 35/00*** | (2006.01) |
| *D06F 39/02* | (2006.01) |

(52) U.S. Cl.

CPC ..... *C11D 17/0039* (2013.01); *D06F 35/00* (2013.01); *D06F 35/006* (2013.01); *D06F 39/02* (2013.01); *Y10T 428/2982* (2015.01)

(58) Field of Classification Search

None

See application file for complete search history.

(56) References Cited

U.S. PATENT DOCUMENTS

| | | | | |
|---|---|---|---|---|
| 4,661,327 | A * | 4/1987 | Horton | 423/7 |
| 4,842,761 | A * | 6/1989 | Rutherford | 510/297 |
| 5,783,543 | A * | 7/1998 | Fleckenstein et al. | 510/280 |
| 2007/0111002 | A1* | 5/2007 | Xia et al. | 428/407 |

(Continued)

FOREIGN PATENT DOCUMENTS

| | | | |
|---|---|---|---|
| CN | 2291428 | Y | 9/1998 |
| CN | 101466482 | A | 6/2009 |
| CN | 101886321 | A | 11/2010 |
| CN | 102061588 | A | 5/2011 |

(Continued)

OTHER PUBLICATIONS

International Search Report (PCT/ISA/210) mailed on Mar. 15, 2012, by the Chinese Patent Office as the International Searching Authority for International Application No. PCT/CN2011/082078.

*Primary Examiner* — Lorna M Douyon

(74) *Attorney, Agent, or Firm* — Buchanan Ingersoll & Rooney PC

(57) ABSTRACT

A solid particle for washing and the washing method using the same are provided. The solid particle is a polymer solid particle, wherein open pores are distributed on the solid particle surface. The washing method using the solid particle comprises steps of separating the articles to be washed with the solid particles, rinsing the articles to be washed and drying the articles to be washed.

13 Claims, 3 Drawing Sheets

(56) References Cited

U.S. PATENT DOCUMENTS

| | | | | |
|---|---|---|---|---|
| 2007/0185003 | A1* | 8/2007 | Iavarone et al. | 510/475 |
| 2008/0194706 | A1* | 8/2008 | Karl et al. | 514/772.3 |
| 2009/0035337 | A1* | 2/2009 | Artiga-Gonzalez et al. | 424/401 |
| 2009/0118383 | A1* | 5/2009 | Mori et al. | 521/38 |
| 2009/0217461 | A1 | 9/2009 | Burkinshaw et al. | |
| 2010/0313907 | A1* | 12/2010 | Sinha et al. | 134/1 |
| 2011/0034364 | A1* | 2/2011 | Gluesen et al. | 510/297 |
| 2011/0271459 | A1* | 11/2011 | Di Bono | 8/137 |

FOREIGN PATENT DOCUMENTS

| | | | |
|---|---|---|---|
| EP | 1 533 365 | A1 | 5/2005 |
| EP | 2 494 020 | | 9/2012 |
| JP | 61-37900 | | 2/1986 |
| JP | 01-229099 | A | 9/1989 |
| JP | 04-142400 | | 5/1992 |
| WO | WO 2009/127587 | A1 * | 10/2009 |
| WO | WO 2010/043844 | A1 * | 4/2010 |
| WO | WO 2011/064581 | A1 | 6/2011 |

* cited by examiner

SOLID PARTICLE FOR WASHING AND WASHING METHOD USING THE SAME

FIELD OF THE INVENTION

The present invention relates to the technical field of washing, in particular, to a solid particle used for washing, and the washing method using the solid particle.

BACKGROUND OF THE INVENTION

The washing media used for washing comprises the following: 1. water; 2. organic solvent, which is applicable to removing hydrophobic stains; 3. air, such as liquid $CO_2$; 4. plastic particles, for example, the Chinese patent application CN 101466482A disclosed a new washing method on Jun. 24, 2009, in which nylon particles are taken as the washing medium, and the stains on the clothes is absorbed by means of the polar groups on the surface of nylon, such as —OH, thus achieving the purpose of removing stains.

However, the application of the above-mentioned washing media also has the following deficiencies: 1. if water is used as a washing medium, there will be very large water consumption; 2. if an organic solvent is used, the organic solvent is highly toxic, and distillation has a low security coefficient in the recycling of the organic solvent; 3. if air is used as a washing medium, a good air tightness is required in the system, a high pressure is required in liquefying gas, and the liquidation has a low security coefficient, and complicated process; 4. the application of plastic particle as a washing medium is the result of the latest research. Compared with water as washing medium, the hydrophobic stains is more easily removed by the method using the plastic particle as washing medium ; compared with the organic solvent and the liquid air as washing medium, the method is more environmental friendly and easier to operate. However, the nylon particle has a limited ability to absorb and remove stains, and it can obviously dye the clothes so that the stains cannot be thoroughly removed.

SUMMARY OF THE INVENTION

In order to overcome the defect of the plastic particle which has a limited absorption capacity and easily dyes the articles as a washing medium, the present invention provides a solid particle. When the surface of the articles is washed by the solid particle in accordance with the present invention, with a plurality of open pores on the surface of the solid particle, the solid particle has a good absorption capacity and a high surface activity, and thus can easily and thoroughly remove contaminants from the surface of the articles to be washed. The present invention also provides a washing method using the solid particle.

The technical scheme adopted in the present invention is a solid particle for washing. The solid particle is a polymer solid particle, wherein an open pores are distributed on the surface of the solid particle.

With smooth surfaces, the extent of the binding between the existing polymer solid particles and the contaminants is not enough, thus causes a bad washing effect and makes the articles to be washed dyed easily. The existing polymer solid particles are replaced by the polymer solid particle with a plurality of open pores on its surface, and the plurality of these pores can absorb and remove the contaminants during washing. For these pores, the smaller the diameter is, the better the absorbing and removing effects are. If the diameter is further reduced to less than or equal to 100 nm, the absorption capacity will have a qualitative leap. The absorption capacity and decontamination effect increase several times, because of the very large specific surface area and surface energy of the pores of the particles. Therefore, the polymer solid particle with open pores on its surface can have very good washing effects and prevent the articles to be washed from being dyed.

Preferably, the surface layer of the solid particle is a layer with pore, and the interior of the particle is of a solid construction.

Preferably, the interior of the solid particle is distributed with open pores.

Preferably, the interior of the solid particle is of a solid construction.

Preferably, the diameter of the pore of the solid particle is 10 nm~100 um.

Preferably, the density of the pore of the solid particle is $10^3$ number/$cm^3$~$10^{12}$ number/$cm^3$.

Preferably, the density of the solid particle is 0.3 g/$cm^3$~1 g/$cm^3$.

Preferably, the solid particle is in the shape of ball, cube, cylinder, oval or crescent.

Preferably, the average size of solid particle is 1 mm~10 mm.

Preferably, the polymer is selected from one of PP, PE, PS, PVC, EVA, PA or PET, or a mixture of one or a plurality of the aforesaid materials.

Preferably, the solid particle contains an inorganic powder.

Preferably, the solid particle contains a magnetic material with a mass percent of 5% to 10%.

Preferably, the magnetic material is selected from ferrum, cobalt or nickel.

Preferably, the magnetic material is selected from an alloy containing ferrum, cobalt or nickel, or two thereof, or three thereof.

Preferably, the magnetic material is selected from ferrum or ferrous alloy.

Preferably, the magnetic material is a particle with a size of 0.01 mm~2 mm.

A washing method using the solid particle, characterized in that, the washing method comprises the following steps: washing the articles to be washed with the solid particle; separating the articles to be washed from the solid particle; rinsing the articles to be washed; and drying the articles to be washed.

The above-mentioned method can thoroughly remove the contaminants on the articles to be washed, with convenient operation.

Preferably, a neutral nonionic surfactant is also used in the step of washing the articles to be washed with the solid particle.

In the step of washing the articles to be washed with the solid particle, the mass ratio of the articles to be washed to the solid particle is 1:0.5~1:5, preferably 1:1~1:3.

Preferably, the step of separating the articles to be washed from the solid particle is conducted in a magnetic field.

The beneficial effects of the present invention: as a washing medium, the polymer solid particle with a plurality of open pores on its surface has significantly better contaminant-removing and dyeing-preventing capacities than those of the common polymer solid particles; the pore structure on the surface can save the materials, protect the environment, and reduce the cost; the method described in the present invention is simple and convenient.

BRIEF DESCRIPTION OF THE DRAWINGS

By referring to the drawings, the structure of the polymer solid particle described in the embodiments of the present invention is described in detail hereinbelow.

Wherein, 1. polymer solid particle, 2. pores, 3. pore wall, 5. interior solid core of the particle, 6. channel between pores, 11. shell, 12. outer tub, 13. inner tub, 14. scraper, 15. electromagnet.

DETAILED DESCRIPTION OF PREFERRED EMBODIMENTS

Embodiment 1

Figure 1:
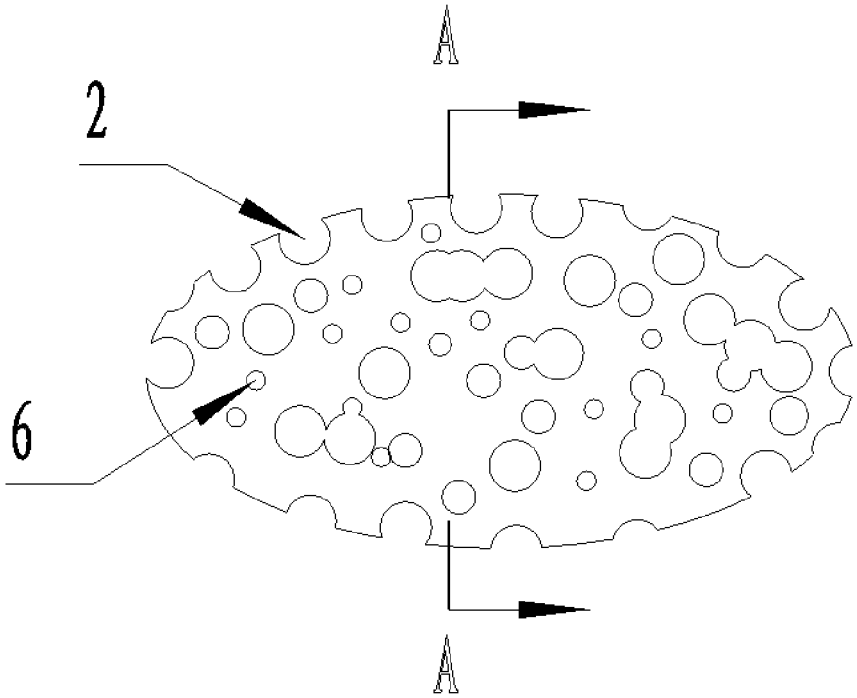
FIG. 1 is a schematic diagram of the external surface of the polymer solid particle in the embodiments of the present invention.

FIG. 1 is the polymer solid particle 1 in the embodiment. The surface of the particle are distributed a plurality of open pores 2 and channels 6 between pores. The interior of the particle 1 is of a solid construction, namely, there is an interior solid core 5 in the particle. The surface layer of the particle is a pore layer where there is a plurality of open pores 2. The periphery of the pore is a pore wall 3. The pores are connected by the channels 6. See FIG. 2.

With the smooth surfaces, the extent of the binding between the existing polymer solid particles and the contaminants is not enough, thus causes a bad washing effect and makes the articles to be washed dyed easily. Such washing medium is replaced by a polymer solid particle with a plurality of open pores on its surface, and the pluralities of these pores can absorb and remove the contaminants during washing. The open pore refers to the interior of the pore being connected to the outside. The smaller their diameter is, the better their absorbing and removing effects are. If the diameter is further reduced to less than or equal to 100 nm, the absorption capacity will have a qualitative leap. The absorption capacity and decontamination effect increase several times, because of the very large specific surface area and surface energy of the pores of the particle. Therefore, the polymer solid particle with open pores on its surface can have very good washing effects and prevent the articles to be washed from being dyed. In addition, the pores can save the materials, protect the environment, and reduce the cost.

In addition, the surface layer of the solid pore is a pore layer, and the interior of the particle is of a solid construction. As the volume of the pore layer on the surface of the particle accounts for 0.01%-20% of the total volume of the solid particle, during washing, the contaminants can be absorbed at the surface or surface layer of the particle, not enter the center of the particle. In this way, the particle can be easily cleaned for reuse.

For suitable washing application, the percent of pores of the solid particle is 50%~100%; the diameter of the pore of the solid particle is 10 nm~100 um; the density of the pore of the solid particle is $10^3$ pores/cm$^3$~$10^{12}$ pores//cm$^3$; the density of the solid particle is 0.3 g/cm$^3$~1 g/cm$^3$; the solid particle is in the shape of a ball, a cube, a cylinder, an oval or a crescent; and the average size of the solid particle is 1 mm~10 mm.

The common polymer materials with pores on their surfaces are soft and elastic, such as the foamed polystyrene particles used in thermal insulation in architecture field. The surface of the polymer particles is also a foaming structure and contacts with the surface of fabrics like hand rubbing during washing. The interconnection of pores on the surface of the polymer particle makes the absorption and discharge of the contaminants available. Furthermore, in the contact with fabrics, the pore wall 3 on the surface of the polymer particle works like a toothbrush, to reduce the cohesion between the contaminants and fabrics.

The polymer for preparing the polymer solid particle is selected from one or more of the group consisting of PP, PE, PS, PVC, EVA, PA and PE. For generating pores on the surface of the solid particle and adjusting its density, an inorganic powder is added to the polymer. To ensure the denser and more uniform pores, the dense powder should be finer and more uniform. The inorganic powder added into the polymer solid particle can be selected from talcum powder, calcium carbonate. And an inorganic nano-powder is better. The powder mainly serves as a nucleating agent to form pores. In addition, the powder with silver ion can be added, so that the polymer solid particle can sterilize bacteria.

The method for preparing the polymer solid particle is as follows: first, blending uniformly the polymer with the power for granulation; then soaking the particle in the organic solvent xylene for 8 to 48 hours for swelling; then soaking the particle in a strongly acidic solution for 0.1 to 10 hours to dissolve the powder in the particle. Thus, after the powder on the surface of the particle dissolves, pores will appear on the surface, and the interior of the particle is of a solid construction.

The washing method in the embodiment is realized by means of the following scheme: before washing, the polymer solid particle 1 is stored in a storage tank of the washing machine, the washing assistant can be quantitatively added through an automatic adding device, and the amount of water to be added can be controlled by a flow meter. The process for washing clothes with the polymer particle includes: opening the bleeder valve, putting the polymer solid particle in the storage tank into a roller, and adding soap and water through the pipe to the roller by the automatic adding device and a quantitative water adding device to soak the clothes. The washing time is 10-60 minutes, and the washing temperature is 50-70 degrees. The steam heating can be applied. The mass ratio of the articles to the solid particle is 1:0.5~1:5, and 1:1~1:3 preferably. After washing, the separation of the polymer particle from clothes proceeds. The polymer particle and clothes are spin-dried at a medium-high speed, and the dirty water is discharged. The speed of the spin-drying is 150-1000 r/min, and the time of the spin-drying is 5-10 minutes. The spin-drying is followed by the rinsing. According to the preset water consumption, the water flows in, and the rinse proceeds for 5-20 minutes. Then the clothes are dried after rinsing. The speed and time of the spin-drying can refer to the ones in the first spin-drying. According to the degree of the contamination of the clothes, there can be a second and third rinsing. After rinsing, the clothes are to be dried and separated from the particle by the centrifugal method. The inner tub rotates at a medium-high speed, and the rotating speed is 150-800 r/min, Opening the feed inlet, the polymer solid particle 1 can enter the storage tank through the feed inlet on the condition of high-speed centrifugal rotation for recycling. The particle can be rinsed. The particle enters into the tub through the opened feed outlet, and a small amount of water is added; the rinsing time is 10-40 minutes. The rinsing is followed by a spin-drying at a speed of 100-800 r/min. After the spin-dying, the feed inlet is open for the recycling of the particle through the high-speed centrifugal rotation. During washing, a neutral nonionic surfactant is also used with the solid particle, thus washing effect is better, and it is easy to remove the contamination.

The clothes is washed by the polymer solid particle of the embodiment. Because of a plurality of open cores on the surface, the polymer solid particle in the embodiment has a strong absorbing and decontamination capacity. It has an ideal effect to remove hydrophilic and hydrophobic contaminants, and the polymer solid particle can avoid to dye the clothes. In addition, compared with the common polymer, the surface layer of pores of the polymer solid particle in this intention can save the materials, protect the environment, and reduce the cost.

Embodiment 2

Figure 3:
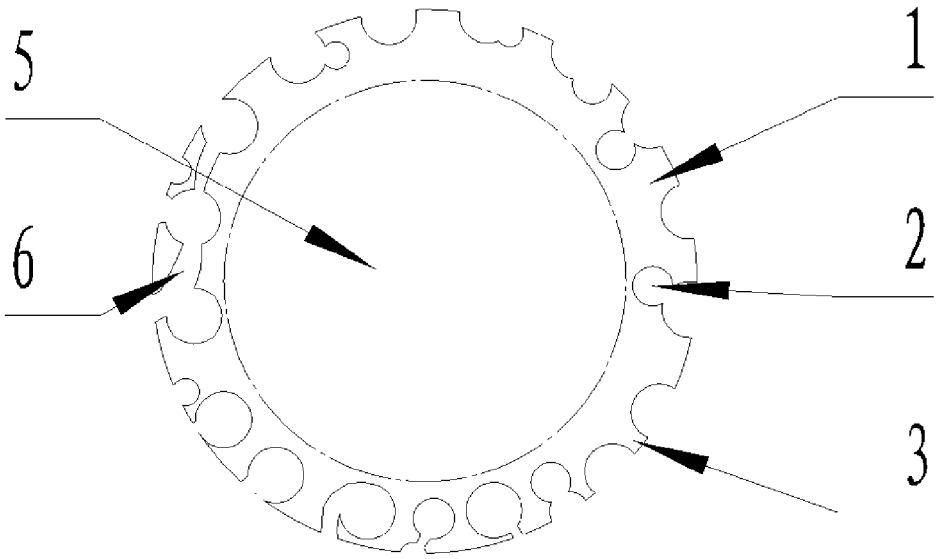
FIG. 3 is a section view of the polymer solid particle of a second embodiment 2.

The surface structure of the polymer solid particle for washing in the embodiment is shown in FIG. 1, and its section view is shown in FIG. 3. After the polymer solid particle absorbs contaminants, the contaminants will enter the interior of the open pores on the particle surface and may also enter the deep pores through the pores on the surface. The particle shall be washed in case of reuse. It is hard to remove the contaminants which enter the particle deeply. Therefore, there must be only open pores on the polymer solid surface, rather than interior that is, the inside of the particle is a solid construction. When the articles to be washed are washed by using the polymer solid particle, the contaminants will only attach to the particle surface. Thus, the contaminants will be removed easily and the particle can be used repeatedly.

The polymer solid particle, which only has open pores on the surface, can be obtained by means of controlling the time of soaking it in strongly acid solution after swelling. The time of soaking is 0.1-0.5 h.

Embodiment 3

Figure 4:
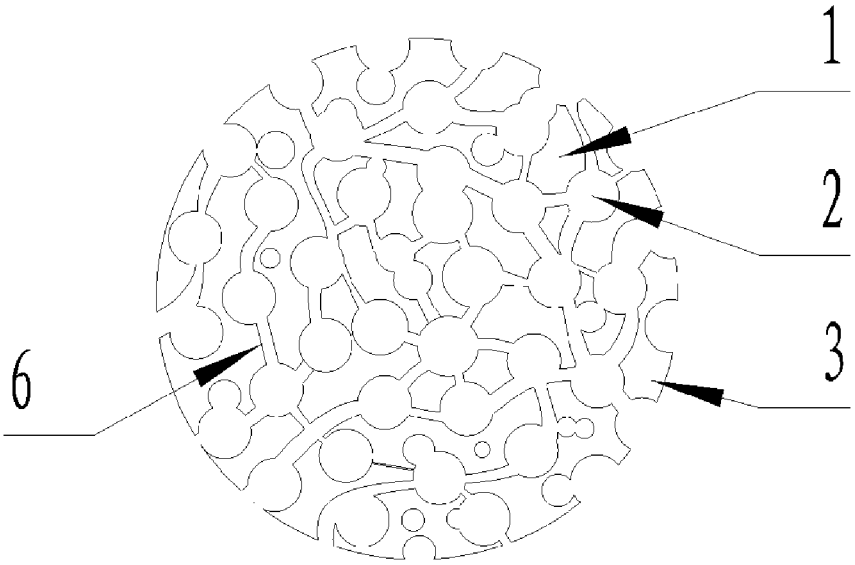
FIG. 4 is a section view of the polymer solid particle of a third embodiment 3.
Figure 5:
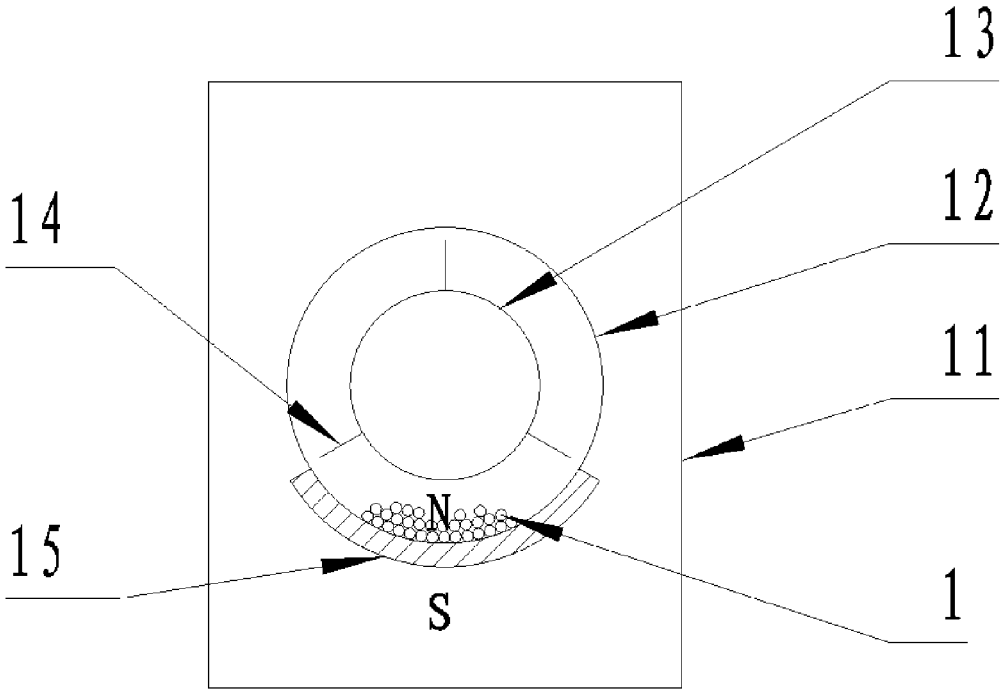
FIG. 5 is a schematic diagram of the washing machine used in a fourth embodiment 4.

The surface structure of the polymer solid particle for washing in the embodiment is shown in FIG. 1 and its section view is shown in FIG. 4. There are a plurality of open pores on the surface and interior of the polymer solid particle. The polymer solid particle can be made by means of physical foaming or chemical foaming. The foaming agent is added in polymer melt and then the pores with different sizes and shapes are obtained by means of controlling the additive amount of the foaming agent and foaming temperature and time.

In the embodiment, there're a plurality of pores on the surface and interior of the polymer solid particle, which can save materials.

Embodiment 4

The embodiment is an improvement of the aforesaid three embodiments. To separate clothes from the particle after washing, the solid particle 1 in the embodiment contains a magnetic material with a mass percent of 5%~10%.

The polymer solid particle needs to be separated from clothes after washing by using the polymer solid particle. However, due to the existence of the surface active agent and water, the separating effect of the polymer solid particle from clothes is not good, especially in automatic washing equipment, such as the washing machine. Although the manual separation can be adopted, the washing efficiency will be decreased obviously. When a magnetic material being attracted is added into the polymer solid and a magnetic field is set up around the inner tub of the washing machine, the polymer solid particle will be separated from clothes and then fixed on the surface of the inner tub. In this way, it is avoided that the polymer solid particle being separated from clothes sticks to each other again. Thus the efficiency of separating the particle from clothes is improved. To prevent the rusted magnetic material on the solid particle surface from contaminating articles to be washed, it's necessary to remove the magnetic material particles on the solid particle surface. Consequently, open pores will form on the solid particle surface correspondingly.

The magnetic material or material which can be attracted by the magnetic field is selected from one of ferrum, cobalt or nickel, or an alloy containing two thereof, or three thereof. In order to reduce the cost and ensure that clothes and the particle are separated easily, ferrum or ferroalloy is used preferentially.

In order to easily make the production of the solid particle for washing, the magnetic material is a particle with a particle size of 0.01 mm-2 mm. Meanwhile, to make sure a uniform performance of the magnetic particle, the preferable particle size is 0.1 mm-1 mm.

In order to obtain good washing effects, the average particle size of the solid particle for washing is 1 mm-5 mm. The average particle size of the particle for washing is 1 mm-3 mm.

The magnetism of the solid particle is better to disappear with the magnetic field in order to make it separate from the clothes easily and for the convenience of recycling of separated particles. The mass percent of magnetic material in the solid particle for washing is 5%-10%, in which 5%, 6%, 7%, 8%, 9% and 10% are available. The mass percent of the polymer material is 50%-95%, in which 50%, 60%, 70%, 80%, 90% and 95% are available.

Figure 2:
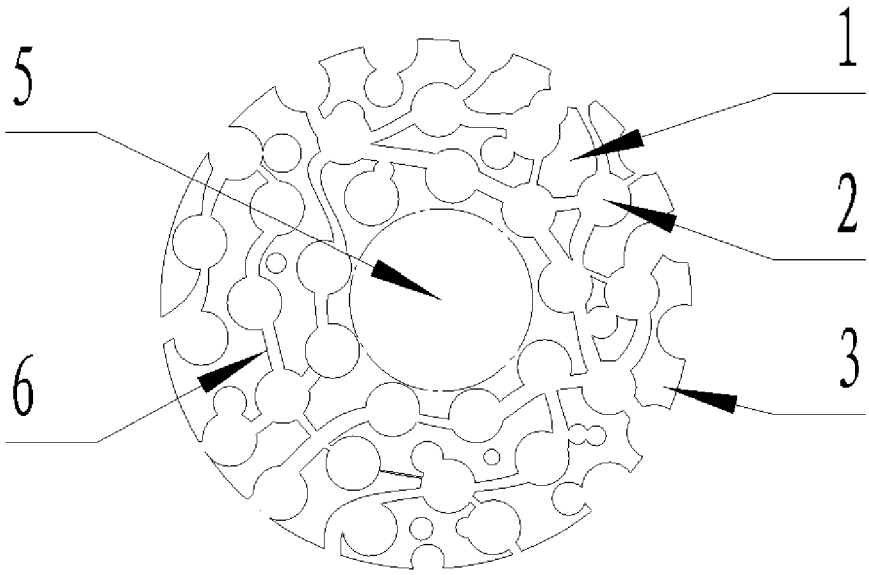
FIG. 2 is a section view of the polymer solid particle of a first embodiment.

In the embodiment, the method for preparing the solid particle for washing comprises: ferrum particles and PA (mass rate: 7:93) being evenly mixed and extruded by the extruding machine, and then the solid particle being obtained by the pelletizer. The particle is immersed in strongly acid solution, such as hydrochloric acid solution, for 30 minutes, so pores are left after the magnetic material on the particle surface is dissolved and then the particle is dried. The preparation of the solid particle is completed as shown in FIG. 1 and FIG. 2.

The washing method in the embodiment is introduced by referring to FIG. 4. The washing machine comprises a shell 11, an outer tub 12 arranged in the shell, an inner tub 13 arranged in the outer tub, a scraper 14 arranged on the external surface of the inner tub 13 to drive the solid particle to move upward along the bottom of the outer tub, a magnetic field arranged in outer tub 12. The magnetic field is generated by an electromagnet 15. The electromagnet will produce a magnetic field when the solid particle and clothes are required to be separated, that is, the separating steps of the articles to be washed and the solid particle in embodiment 1 are conducted in the magnetic field.

The polymer solid particle for washing with the magnetic material will be attracted by the magnetic field inside the outer tub to the position in the outer tub corresponding to the magnetic pole of the electromagnet. Since the magnetic field is generated by the electromagnet, the magnetic field can be made as required.

Compared with general polymer solid particles, the separating time is shortened by 50%-80%, and it is effectively avoided to cross color. In conclusion, the solid particle for washing and clothes can be separated easily after washing and the washing efficiency can also be improved.

The invention claimed is:

1. A solid particle for washing, wherein, the solid particle is a polymer solid particle, and open pores are distributed on a surface of the solid particle, wherein the solid particle comprises a magnetic material with a mass percent of 5% to 10% and an inorganic powder, the magnetic material being selected from one of cobalt or nickel, or an alloy containing one of ferrum, cobalt or nickel, or two thereof, or three thereof, and the inorganic powder comprising talcum powder or calcium carbonate;

wherein the magnetic material has a size of 0.01 mm~2 mm;

wherein a density of the pore of the solid particle is $10^3$ number /$cm^3$~$10^{12}$ number /$cm^3$; and wherein a diameter of the pore of the solid particle is 10 nm~100 μm.

2. The particle according to claim 1, wherein, a surface layer of the solid particle is a pore layer, and an interior of the particle is of a solid construction.

3. The particle according to claim 1, wherein, an interior of the solid particle is of a solid construction.

4. The particle according to claim 1, wherein, a density of the solid particle is 0.3 g/$cm^3$~1 g/$cm^3$.

5. The particle according to claim 1, wherein, the solid particle is in a shape of ball, cube, cylinder, oval or crescent.

6. The particle according to claim 1, wherein, an average size of the solid particle is 1 mm~10 mm.

7. The particle according to claim 1, wherein, the polymer is selected from one of polypropylene, polyethylene, polystyrene, polyvinylchloride, ethylene-vinyl acetate, polyamide, or polyethylene terephthalate, or a mixture of two or a plurality of the aforesaid materials.

8. The particle according to claim 1, wherein, open pores are distributed in an interior of the solid particle.

9. The particle according to claim 1, wherein the magnetic material is a ferrous alloy.

10. A washing method comprising the following steps:

washing articles to be washed with the solid particle according to claim 1;

separating the articles to be washed from the solid particle;

rinsing the articles to be washed; and drying the articles to be washed.

11. The method according to claim 10, wherein, a neutral nonionic surfactant is used in the step of washing the articles to be washed with the solid particle.

12. The method according to claim 10, wherein, in the step of washing the articles to be washed with the solid particle, a mass ratio of the articles to be washed to the solid particle is 1:0.5~1:5.

13. The method according to claim 10, wherein, the step of separating the articles to be washed from the solid particle is conducted in a magnetic field.

* * * * *